US012077913B2

(12) United States Patent
Prause et al.

(10) Patent No.: US 12,077,913 B2
(45) Date of Patent: Sep. 3, 2024

(54) PAPER MACHINE CLOTHING

(71) Applicant: VOITH PATENT GMBH, Heidenheim (DE)

(72) Inventors: Isabel Prause, Ulm (DE); Robert Eberhardt, Ellwangen (DE); Hubert Walkenhaus, Kerpen (DE); Torsten Wich, Appleton, WI (US); Cedric Fitzer, Weissenhorn (DE); Uwe Koeckritz, Heidenheim (DE); Thomas Hensler, Cincinnati, OH (US); Reinhard Holl, Lauingen (DE)

(73) Assignee: Voith Patent GmbH, Heidenheim (DE)

( * ) Notice: Subject to any disclaimer, the term of this patent is extended or adjusted under 35 U.S.C. 154(b) by 0 days.

(21) Appl. No.: 17/798,655

(22) PCT Filed: Feb. 4, 2021

(86) PCT No.: PCT/EP2021/052629

§ 371 (c)(1),
(2) Date: Aug. 10, 2022

(87) PCT Pub. No.: WO2021/170361

PCT Pub. Date: Sep. 2, 2021

(65) Prior Publication Data

US 2023/0079374 A1 Mar. 16, 2023

Related U.S. Application Data

(60) Provisional application No. 62/982,393, filed on Feb. 27, 2020.

(30) Foreign Application Priority Data

Mar. 27, 2020 (DE) ..... 10 2020 108 511.7

(51) Int. Cl.
*D21F 1/00* (2006.01)
*D21F 11/00* (2006.01)

(52) U.S. Cl.
CPC ..... *D21F 1/0036* (2013.01); *D21F 11/006* (2013.01)

(58) Field of Classification Search
CPC ..... D21F 7/083; D21F 7/10; D21F 1/0036; D21F 1/0054
See application file for complete search history.

(56) References Cited

U.S. PATENT DOCUMENTS 6,821,385 B2 11/2004 Burazin et al.
10,934,664 B2 3/2021 Eberhardt et al.
(Continued)

FOREIGN PATENT DOCUMENTS

DE 60225580 T2 4/2009
WO 2014166985 A1 10/2014
(Continued)

*Primary Examiner* — Jacob T Minskey
*Assistant Examiner* — Matthew M Eslami
(74) *Attorney, Agent, or Firm* — Laurence A. Greenberg; Werner H. Stemer; Ralph E. Locher

(57) ABSTRACT

A covering for a machine for producing or processing a fibrous web, in particular a paper or tissue web. The covering includes a basic covering which has a web-contacting upper side and an underside, and a plurality of polymer elements. The polymer elements are welded onto the upper side and at least some of the polymer elements are in the form of yarn-shaped and/or tape-shaped polymer elements.

18 Claims, 2 Drawing Sheets

(56) References Cited

U.S. PATENT DOCUMENTS

| | | | | |
|---|---|---|---|---|
| 2003/0085013 | A1* | 5/2003 | Burazin | D21F 11/006 139/383 A |
| 2010/0230064 | A1* | 9/2010 | Eagles | D04H 3/02 156/191 |
| 2014/0014285 | A1* | 1/2014 | Straub | D21F 1/80 162/348 |
| 2018/0220726 | A1 | 8/2018 | Morton et al. | |
| 2019/0112763 | A1* | 4/2019 | Eberhardt | D21F 11/14 |

FOREIGN PATENT DOCUMENTS

| | | | |
|---|---|---|---|
| WO | 2017139786 | A1 | 8/2017 |
| WO | 2017178414 | A1 | 10/2017 |
| WO | 2018081498 | A1 | 5/2018 |

* cited by examiner

PAPER MACHINE CLOTHING

FIELD AND BACKGROUND OF THE INVENTION

The invention relates to a clothing for a machine for producing or processing a fibrous material web, especially a paper or tissue web, the clothing comprising a base clothing which has a web-contacting upper side and a bottom side and also a plurality of polymer elements.

The production of fibrous material webs, especially paper or tissue webs, involves the use of a multitude of different clothings. Said clothings can be used for transport of the web, but also for dewatering and structuring.

In the region of the forming section, use is nowadays usually made of woven wires. An alternative to this is the use of perforated polymer films.

In the region of the press, use is usually made of press felts in which one or more batt layers are applied to a woven or else nonwoven base structure.

In order to increase the effectiveness of said clothings, various solutions have been proposed in the past.

WO 2014/166985 describes clothings on which patterns were produced by extrusion of polymer material. Said patterns serve for structuring the web, especially in the case of tissue webs.

DE 602 25 580 describes batt elements raised for structuring.

Furthermore, it is known from WO 2018/081 498 to fasten platelet like polymer elements on a base woven fabric, especially also by solvent welding. Said polymer elements are intended to serve for structuring a paper web, too.

WO 2017/139786 describes a clothing in which an extruded netting material is applied to a base woven fabric on a base woven fabric. Said clothing is intended to serve for structuring of the web, too.

SUMMARY OF THE INVENTION

It is an object of the present invention to propose alternative clothings and the associated production processes to allow structuring of a fibrous material web.

Furthermore, it is a goal of the present invention to propose clothings having an improved or specific dewatering effect.

Lastly, it is a further goal of the present invention to propose robust and wear-resistant clothings.

The object is achieved according to the invention by an embodiment as claimed. Further advantageous features of the embodiment according to the invention can be found in the dependent claims.

The following sentences, which are not patent claims, will be used to describe the various concepts of this application in more detail.

Sentence 1. Clothing for a machine for producing or processing a fibrous material web, especially a paper or tissue web, the clothing comprising a base clothing which has a web-contacting upper side and a bottom side and also a plurality of polymer elements which are welded onto the upper side.

The welded connection of the polymer elements with the surface of the clothing achieves a very strong and wear-resistant connection. Polymer elements fastened in this way can therefore be used as structuring elements suitable for continuous and reliable operation of the clothing.

Moreover, such a welded connection can be realized largely independently of the nature of the upper side of the clothing. This is especially relevant with respect to the extrusion process described in WO 2014/166985. Whereas the extruded polymer elements adhere very well on many woven fabrics, extrusion onto batt surfaces of felts, for example, does not produce clothings which can be operated continuously in a machine for production of a fibrous material web. Tests by the applicant have revealed that very strong and durable joint connections can be achieved on the same substrate by means of welding, for example by means of NIR transmission welding.

Besides transmission welding, specifically NIR transmission welding, it is also possible to use other welding methods, for example hot-air welding or ultrasonic welding.

However, in the context of the invention, the possibility of combining weld-on of the polymer elements with other forms of connection is also contemplated. In particular, what can be contemplated is that the extruded polymer elements known per se are additionally welded to the surface. Firstly, this is advantageous for processing, since the polymer elements are already fixed in the right place on the surface of the clothing after extrusion and do not have to be complicatedly held in their position during subsequent welding. Secondly, said polymer elements, which are still pasty upon extrusion, cling to the surface of the clothing to a certain extent, such that an enlarged contact surface is formed between the surface of the clothing and the polymer element, and this leads to a stronger welded connection during subsequent welding.

Sentence 2. Clothing according to any of the preceding sentences, wherein the base clothing is completely or largely transparent to light within the NIR range between 780 [nm] and 1300 [nm].

The polymers usually used for clothings, such as polyamides, but also polyesters, meet these requirements.

Sentence 3. Clothing according to any of the preceding sentences, wherein the polymer elements are completely or largely absorbent for light of a wavelength within the NIR range between 780 [nm] and 1300 [nm].

This can, for example, also be achieved by adding an additive to a polymer which is transparent per se, such as a polyamide or polyester. Carbon black is very highly suited for this purpose.

Alternatively or additionally, the polymer elements can also be coated with an absorbent layer, whereas the interior of the polymer element is largely transparent.

Sentence 4. Clothing according to any of the preceding sentences, wherein a medium is provided between the upper side of the base clothing and the polymer elements, which medium completely or largely absorbs for light of a wavelength within the NIR range between 780 [nm] and 1300 [nm].

Such a medium can be in the form of a liquid medium, such as Clearweld™, a powder, a film, a coating or an absorbent adhesive.

The advantage of a clothing in which—based on a wavelength range—the base clothing is transparent and the polymer elements are absorbent or in which only the contact surface between the polymer element and the base clothing is absorbent is that the welded connection can be realized by means of transmission welding comparatively easily. When the clothing is irradiated with light of the appropriate wavelength—for example using a laser—most of the clothing remains cold, whereas only the small, absorbent part—for example the polymer elements or the connection medium—heats up and melts. As a result of application of pressure during melting, the two media can be welded together. It can therefore be ensured that essential properties of the base clothing—for example the strength properties thereof—do not change or only change minimally as a result of the welding of the polymer elements.

Furthermore, it is advantageous that a material having good compatibility with the polymer of the upper side of the clothing can be chosen for the polymer elements. In particular, both materials can be identical or come from the same group, for example polyamides.

Sentence 5. Clothing according to any of the preceding sentences, wherein the base clothing comprises or consists of a load-bearing base structure, especially a base woven fabric.

In particular, the clothing can thus consist of a woven fabric onto which polymer elements are welded.

Alternatively, such a load-bearing base structure can also comprise or consist of a laid scrim, a film or the like.

The base clothing, and thus also the entire clothing, can be in the form of a continuous clothing or a seam clothing.

When using a base woven fabric, a continuous circular woven fabric can be used. Alternatively, use can, however, also be made of a woven fabric which is made continuous by means of a—generally detachable—seam.

Sentence 6. Clothing according to any of the preceding sentences, wherein the base clothing has a batt layer which provides the web-contacting upper side of the base clothing.

It is also additionally possible to provide further batt layers. For example, the bottom side of the clothing can also be provided by a batt layer. The batt layer or batt layers are usually connected to the load-bearing base structure by needling.

As already described, the extrusion of polymer material onto a batt layer is not readily possible, or does not provide a permanent connection between batt material and polymer material. From the rest of the prior art as well, there is no known method for permanently realizing such connections. Welding, especially by means of transmission welding, provides a simple, rapid and reliable alternative here.

It has become apparent that transmission welding can be used to achieve very strong connections between the polymer elements and the batt layer. Owing to the only local heating of the two joining partners, there is, however, no disadvantageous structural damage to the polymer elements nor any impairment of the batt layer. In particular, the individual batt fibers are also not welded to one another, but only to the polymer elements. Any impairment of the batt properties such as permeability or compressibility and storage volume is therefore avoided.

Sentence 7. Clothing according to any of the preceding sentences, wherein the base clothing has a batt layer which provides the web-contacting upper side of the base clothing and said batt layer consists of batt fibers having a linear density of less than 67 dtex, especially less than 22 dtex.

It is additionally advantageous if the batt fibers have a linear density of more than 3 dtex, especially 11 dtex or more.

Fiber linear densities within this range make it possible to produce stable welded connections quite easily.

The batt layer can moreover also additionally contain specific fibers such as hot-melt adhesive fibers.

Sentence 8. Clothing according to any of the preceding sentences, wherein at least some of the polymer elements are in the form of yarn-shaped polymer elements.

Sentence 9. Clothing according to any of the preceding sentences, wherein at least some of the polymer elements are in the form of tape-shaped polymer elements, especially with a width of less than 15 mm.

The yarn-shaped or tape-shaped polymer elements can, for example, be arranged in the machine direction (MD) or else in the cross-machine direction (CD). Alternatively, yarn-shaped polymer elements can also be arranged in other directions, for example diagonally on the base clothing.

Sentence 10. Clothing according to either of sentences 8 and 9, wherein the yarn-shaped and/or tape-shaped polymer elements are drawn uniaxially or biaxially.

The yarn-shaped polymer elements can, for example, be in the form of monofilaments or multifilaments.

Examples of suitable uniaxially drawn polymer tapes are those as already used as the basis for adhesive tapes or packaging tapes. The fact that such tapes are in principle suitable for use in clothings is described, inter alia, in WO 2010/068765.

Advantageous materials for the yarn-shaped polymer elements, especially also for the drawn yarn-shaped polymer elements, are polyamides, but also polyethylenes or polyurethanes. In the case of polyurethanes, thermoplastic polyurethanes (TPU) are especially advantageous.

If at least some of the polymer elements, especially all the polymer elements, consist of or comprise a polyurethane, especially a thermoplastic polyurethane, this can have the advantageous effect of the polymer elements being compressed in a treatment nip owing to their elasticity, which can for example bring about improved dewatering of the fibrous material web, and expanding again after leaving the nip, which can lead to a reduction in rewetting.

Furthermore, it is advantageous if the yarn-shaped polymer elements and/or tape-shaped polymer elements are composed of solid material and hence not hollow on the inside. Although hollow yarns can also be easily compressed in the press nip, there is the risk of said hollow yarns becoming brittle and breaking under the high load of the continuous compression and expansion in the nip. The use of hollow yarns is therefore possible in principle. However, the use of polymer elements composed of solid material is preferable. Any desired adjustment of the elasticity of the polymer elements should preferably, as described above, be achieved via the choice of material (e.g., TPU).

Sentence 11. Clothing according to any of sentences 8 to 10, wherein the yarn-shaped and/or tape-shaped polymer elements are arranged in the machine direction of the clothing, or deviate from said machine direction by less than 15°.

In advantageous embodiments, some or all of the yarn-shaped or tape-shaped polymer elements can be arranged spirally on the continuous clothing or clothing made continuous.

The use of drawn polymer elements has the advantage that, besides the structuring effect, they also additionally contribute to the strength of the clothing. Especially if the polymer elements in the machine direction or deviate diagonally from said machine direction by less than 15°, the drawn polymer elements increase the tensile strength of the clothing.

To this end, it is advantageous if the structure of the polymer elements is not impaired or not significantly impaired by the joining process, i.e., by the welding of the polymer elements onto the base clothing, so that the tensile strength of the yarns or tapes achieved by drawing is maintained. Therefore, the transmission welding described above is very advantageous. Very strong welded connections can be produced thereby. Owing to the only local heating of the joining partners at the joining site, the structural damage remains very low.

Furthermore, it can be advantageous if all the polymer elements are of the same kind. When using yarn-shaped polymer elements, the term "of the same kind" is intended to mean that yarns composed of the same material having the same geometry are welded on. Even if said yarns are deformed differently at individual points as a result of the welding process, they are to be referred to as "of the same kind" in the context of this application.

Sentence 12. Clothing according to any of the preceding sentences, wherein at least some, especially all of the polymer elements consist of a material having a hardness of 40 Shore D or more, especially more than 50 Shore D.

The use of polymer material of these hardness ranges provides a particularly good structuring effect. For example, most polyamides and polyethylenes are within this hardness range.

Sentence 13. Clothing according to any of the preceding sentences, especially sentences 7 to 11, wherein at least some, especially all of the polymer elements have a circular cross-section.

This is, inter alia, advantageous because such polymer elements, for example as yarn material, are commercially available in a wide variety of designs. In particular, drawn, yarn-shaped polymer elements having a circular cross-section can be very advantageous if both structuring of the fibrous material web and an increase in the strength of the clothing are to be achieved.

Sentence 14. Clothing according to any of the preceding sentences, especially sentences 8 to 12, wherein at least some, especially all of the polymer elements have a cross-section which is noncircular.

For example, oval cross-sections are conceivable here.

Alternatively, other cross-sections, especially rectangular or square cross-sections, are also conceivable. Especially for the purpose of structuring tissue webs, rectangular or square cross-sections are very advantageous for the polymer elements. The straight edges of these structuring elements mean that the resulting structure in the sheet is very sharply delimited and is generally more clearly identifiable than in the case of round or oval elements.

Sentence 15. Clothing according to any of the preceding sentences, wherein the distance between two adjacent polymer elements is at least 1 mm, preferably between 1.5 mm and 10 mm, particularly preferably between 2 and 5 mm.

Especially when producing tissue papers, structured clothings often have to meet multiple requirements at the same time. Besides dewatering and structuring, they should also additionally protect the thickness or bulk of the tissue product as much as possible.

The web is structured as described by the polymer elements functioning as structuring elements. Moreover, local dewatering is prevented by the increased pressing of the web that takes place at the locations of the structuring elements. This gives rise to a specific topographical and hydraulic marking in the web.

A suitable choice of the distances between the welded-on polymer elements can ensure that the bulk of the tissue web is not impaired too much, even if, for example, the tissue web is pressed on the clothing. It is thus advantageous if a distance of more than 1 mm is observed between two adjacent polymer elements, especially between two adjacent yarn-shaped polymer elements. Distances between 1.5 mm and 10 mm, particularly preferably between 2 and 5 mm, are particularly advantageous. It is usually not disruptive if, in the case of a small portion of the polymer elements or at individual points, the distances between the polymer elements are also smaller.

Sentence 16. Clothing according to any of the preceding sentences, wherein the diameter of a polymer element, especially a yarn-shaped polymer element, is more than 100 μm, preferably between 200 μm and 500 μm.

In the case of polymer elements having a noncircular cross-section, the diameter that can be used is the diameter of the smallest circumcircle.

Exemplary embodiments will be used to elucidate further advantageous characteristics of the invention with reference to the drawings. The features mentioned can not only be advantageously implemented in the combination shown, but can also be individually combined with one another. The figures show in detail:

DETAILED DESCRIPTION OF THE INVENTION

Figure 1:
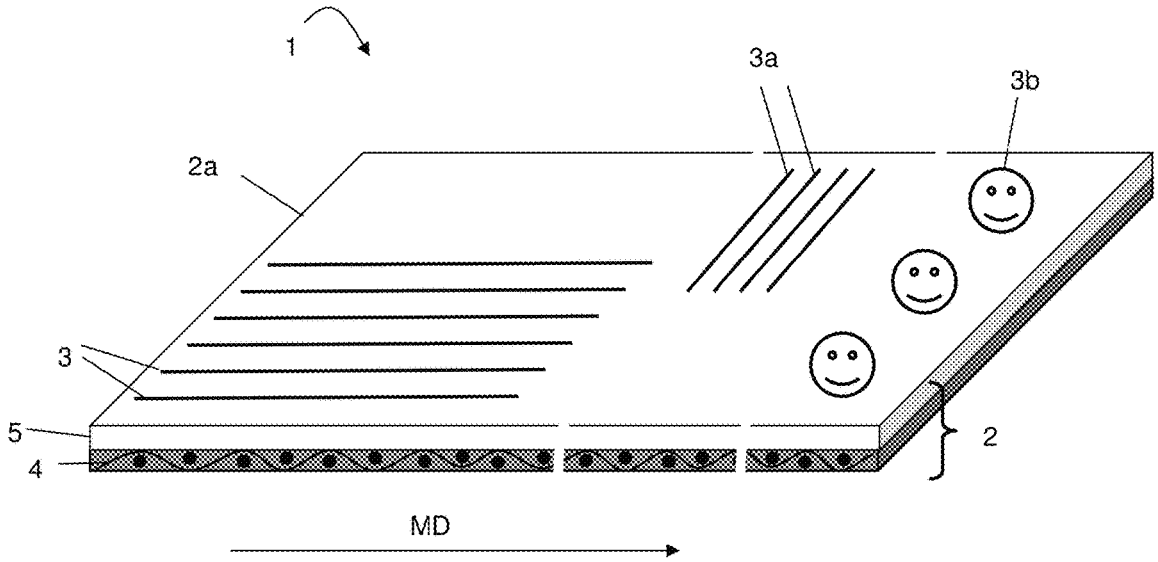
FIG. 1 shows a clothing according to one aspect of the invention

FIG. 1 shows a clothing 1 for a machine for producing or processing a fibrous material web, especially a paper or tissue web. The clothing 1 comprises a base clothing 2 which has a web-contacting upper side 2*a* and a bottom side. Here, the base clothing 2 has a base structure 4, for example in the form of a base woven fabric 4, and a batt layer 5. The batt layer 5 provides the paper-contacting upper side 2*a*, whereas the base structure 4 provides the bottom side. In alternative embodiments, it is also additionally possible to provide a further batt layer underneath the base structure, which then forms the bottom side of the clothing 1. The batt layer 5 can be connected to the base structure 4 by needling, for example. Depicted on the upper side 2*a* are a plurality of polymer elements 3, 3*a*, 3*b*, which are welded onto the upper side 2*a*. FIG. 1 depicts various types of polymer elements 3, 3*a*, 3*b* in order to indicate the variety of options possible in the context of the present invention. In advantageous embodiments of the clothing 1, it is, however, also possible to provide only one or two types of polymer elements 3, 3*a*, 3*b*. The polymer elements 3 and 3*b* are in the form of yarn-shaped or tape-shaped polymer elements. At the same time, they can be polymer elements 3 oriented in the machine direction (MD), polymer elements 3*a* oriented in the transverse direction, or else polymer elements oriented in other directions. 3, 3*a* can. The yarn-shaped or tape-shaped polymer elements 3, 3*a* can be drawn polymer elements 3, 3*a*. They can then serve not only for structuring and dewatering of the web, but also for increasing the strength of the clothing 1. It is, however, also possible to provide undrawn polymer elements 3, 3*a*, 3*b*, which are, for example, applied directly to the upper side 2*a* of the clothing 1 or the batt layer 5 by extrusion. The polymer elements 3*b* are intended to show that the polymer elements 3, 3*a*, 3*b* can also be in the form of purely decorative structuring elements, the purpose of which is almost exclusively that of structuring the fibrous material web. Such polymer elements 3*b* can, for example, be in the form of figurative motifs, letters or company logos.

Said polymer elements 3*b* can then, for example, be extruded or printed onto the surface 2*a*.

Moreover, all the polymer elements 3, 3*a*, 3*b* are welded onto the upper side 2*a*.

Figure 2:
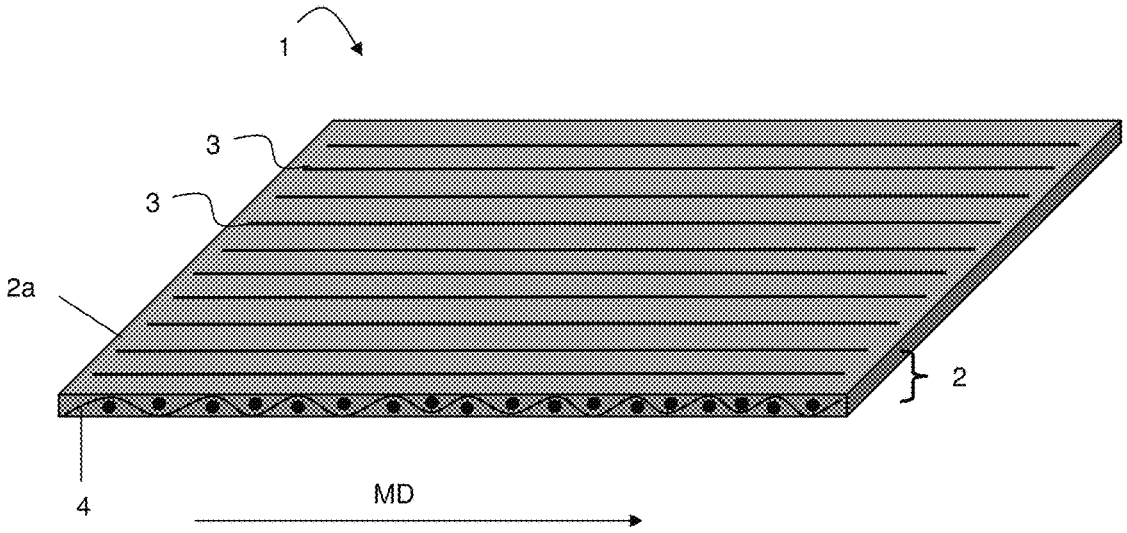
FIG. 2 shows a clothing according to a further aspect of the invention

In the case of the clothing 1 shown in FIG. 2, the base clothing 2 consists of a base structure 4 in the form of a woven fabric 4, yarn-shaped polymer elements 3 drawn in their longitudinal direction are welded onto the upper side 4. The yarn-shaped polymer elements 3 are essentially arranged in the machine direction (MD) of the clothing 3. In particular, the polymer elements 3 can also be arranged spirally. In this case, the polymer elements 3 shown in FIG. 2 each represent the various windings of an individual polymer element 3. Advantageously, said polymer elements 3 are distributed uniformly over the width of the clothing 1 and also extend substantially over the entire length thereof. Such drawn polymer elements 3 perform two different functions in the clothing at the same time. Firstly, they serve for structuring of the fibrous material web and support dewatering. At the same time, they increase the strength, especially the tensile strength, of the clothing 1. To this end, it is again very advantageous if—as is possible especially through the process of transmission welding—both a strong joint connection between the polymer elements 3 and the upper side 2*a* of the base clothing 2 is produced, and the polymer elements 3 are nevertheless not structurally damaged or only insignificantly structurally damaged. In FIG. 2, the base structure 4 is in the form of a base woven fabric 4. Since the drawn, yarn-shaped polymer elements 3 already provide a large share of the tensile strength of the clothing 1, thinner woven fabrics can be used compared to conventional clothings 1. As an alternative to base woven fabrics 4, nonwoven base structures 4 can also be used in clothings 1 like that in FIG. 2. For example, base structures 4 composed of one or more polymer films can be used.

Figure 3:
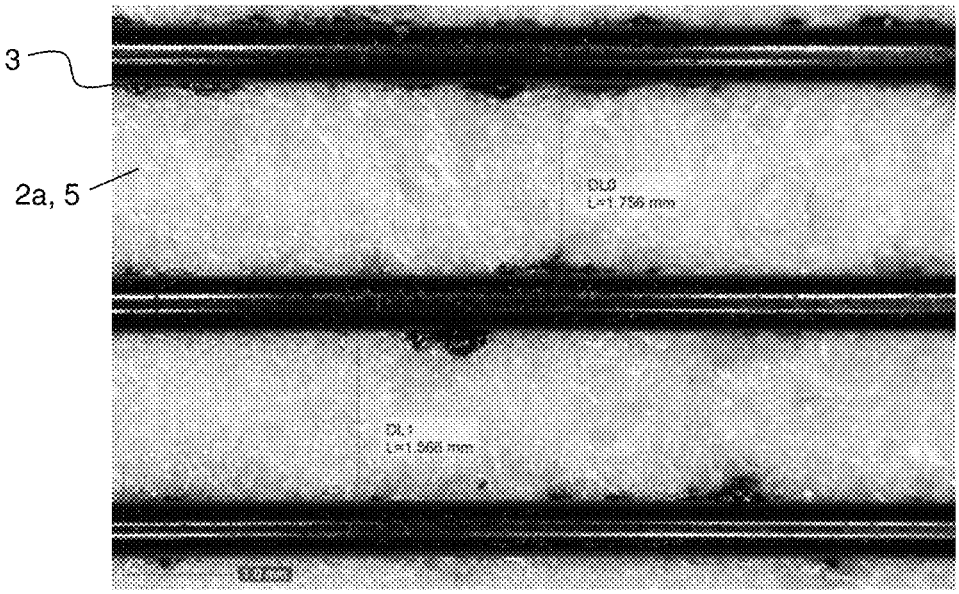
FIG. 3 shows an upper side of a clothing according to a further aspect of the invention

FIG. 3 shows an upper side 2*a* of a clothing 1 such as the one depicted in FIG. 1. The paper-contacting upper side 2*a* is provided by a batt layer 5. Polymer elements 3 are welded onto said batt layer 5 by means of transmission welding. Here, the polymer elements 3 are drawn yarns; alternatively, they could, however, also be undrawn yarn-shaped polymer elements 3, which are, for example, applied directly to the surface 2*a* by extrusion. The fibers of the batt layer 5 are composed of a polymer which is completely or largely transparent to light within the near infrared range between 780 [nm] and 1300 [nm]. Polyamides have this property. The polymer elements 3 in FIG. 3 are colored by addition of an additive—carbon black here—and they absorb the relevant light as a result. The polymer elements 3 can then optionally also consist of the same material as the batt fibers, which allows a very strong welded connection.

The yarn-shaped polymer elements 3 in FIG. 2 can be arranged in almost any way, for example in the machine direction (MD), in the transverse direction (CD) or diagonally. This opens up high degrees of freedom for the structuring of the paper web. The distance between two adjacent polymer elements 3 is advantageously at least 1 mm, preferably between 1.5 mm and 10 mm, particularly preferably between 2 and 5 mm. The polymer elements 3 in FIG. 3 have distances ranging between 1.5 mm and 1.8 mm.

Figure 4:
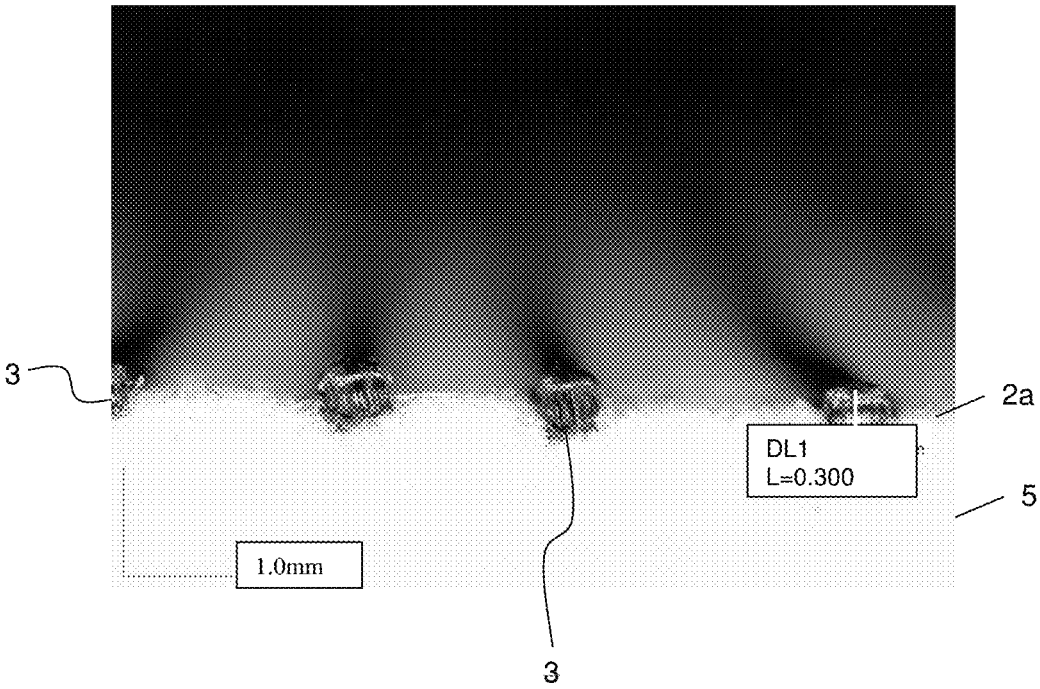
FIG. 4 shows a section through a clothing according to a further aspect of the invention The figures are described in more detail in what follows.

FIG. 4 depicts a section in relation to the clothing 1 from FIG. 3, showing only the batt layer 5 without the underlying base structure 4. Here, the polymer elements 3 have a diameter of 300 μm. Preferably, such polymer elements 3 have diameters between 200 μm and 500 μm. As can be clearly seen in FIG. 4, the structure of the yarn-shaped polymer elements is virtually unchanged even after welding. Although they are pressed somewhat into the batt layer 5 owing to the joining pressure during welding, the polymer elements 3 still distinctly protrude beyond the surface 2*a*, and so they allow reliable structuring of the paper web, tissue web or other fibrous material web.

LIST OF REFERENCE SIGNS

1 Clothing
2 Base clothing
2*a* Upper side
3, 3*a*, 3*b* Polymer elements, structuring elements
4 Base structure
5 Batt layer

The invention claimed is:

1. A clothing for a machine for producing or processing a fibrous material web, the clothing comprising:

a base clothing having a web-contacting upper side and a bottom side opposite said upper side, said base clothing having a batt layer providing said web-contacting upper side of said base clothing, said batt layer being composed of a polymer which is completely or largely transparent to light within the near infrared;

a plurality of uniaxially drawn polymer elements welded onto said upper side;

at least some of said polymer elements being selected from the group consisting of yarn-shaped polymer elements and tape-shaped polymer elements having a width of less than 15 mm; and said base clothing being transparent to light within a near-infrared range between 780 nm and 1300 nm, and said polymer elements being absorbent for light of a wavelength within the near-infrared range between 780 nm and 1300 nm.

2. The clothing according to claim 1, wherein said yarn-shaped polymer elements have a diameter of more than 100 μm.

3. The clothing according to claim 2, wherein the diameter of said yarn-shaped polymer elements is between 200 μm and 500 μm.

4. The clothing according to claim 1, wherein said polymer elements are arranged in a machine direction of the clothing or the polymer elements deviate from the machine direction by less than 15°.

5. The clothing according to claim 4, wherein the clothing is a continuous clothing or the clothing is made continuous and some or all of said polymer elements are arranged spirally on the continuous clothing.

6. The clothing according to claim 1, wherein all of said polymer elements are of the same kind.

7. The clothing according to claim 1, wherein said polymer elements are composed of solid material and are not hollow on an inside thereof.

8. A clothing for a machine for producing or processing a fibrous material web, the clothing comprising:

a base clothing having a web-contacting upper side and a bottom side opposite said upper side, said base clothing having a batt layer being composed of a polymer which is completely or largely transparent to light within the near infrared;

a plurality of uniaxially drawn polymer elements welded onto said upper side;

at least some of said polymer elements being selected from the group consisting of yarn-shaped polymer elements and tape-shaped polymer elements having a width of less than 15 mm; and a medium disposed between said upper side of said base clothing and said polymer elements, said medium being configured to completely or largely absorb light of a wavelength within a near-infrared range between 780 nm and 1300 nm.

9. The clothing according to claim 1, wherein at least some of said polymer elements consist of a material having a hardness of 40 Shore D or more.

10. The clothing according to claim 9, wherein all of said polymer elements consist of a material having a hardness of 50 Shore D or more.

11. The clothing according to claim 1, wherein at least some of said polymer elements have a circular cross-section.

12. The clothing according to claim 1, wherein at least some of said polymer elements have a cross-section which is noncircular.

13. The clothing according to claim 1, wherein all of said polymer elements have a circular cross-section or all of said polymer elements have a noncircular cross-section.

14. The clothing according to claim 1, wherein a distance between two mutually adjacent polymer elements is at least 1 mm.

15. The clothing according to claim 1, wherein the distance between two mutually adjacent polymer elements lies between 2 and 5 mm.

16. The clothing according to claim 1, wherein at least some of said polymer elements are formed of a polyurethane.

17. The clothing according to claim 16, wherein the polyurethane is a thermoplastic polyurethane.

18. The clothing according to claim 8, wherein said medium is selected from the group of a liquid, a powder, a film, a coating, or an absorbent adhesive.

* * * * *